US005408161A

United States Patent [19]

Kishino et al.

[11] Patent Number: 5,408,161

[45] Date of Patent: Apr. 18, 1995

[54] FLUORESCENT DISPLAY DEVICE

[75] Inventors: Takao Kishino; Hiroshi Watanabe, both of Mobara, Japan

[73] Assignee: Futaba Denshi Kogyo K.K., Mobara, Japan

[21] Appl. No.: 63,723

[22] Filed: May 20, 1993

[30] Foreign Application Priority Data

May 22, 1992 [JP] Japan ..... 4-130553
Jun. 29, 1992 [JP] Japan ..... 4-171061

[51] Int. Cl.[6] ..... G09G 3/20; H01J 63/04; H01J 1/62

[52] U.S. Cl. ..... 313/495; 313/496; 313/497

[58] Field of Search ..... 345/44, 45, 47, 48, 345/51, 55; 313/495, 496, 497, 422, 444, 306, 308, 309, 336, 351, 355; 315/169.4

[56] References Cited

U.S. PATENT DOCUMENTS 4,216,470 8/1980 Kishino et al. ..... 313/496
4,455,774 6/1984 Watanabe ..... 313/496
4,562,434 12/1985 Amano ..... 315/169.4
4,563,613 1/1986 Genovese et al. ..... 313/495
4,701,670 10/1987 Watanabe et al. ..... 313/497
4,730,203 3/1988 Watanabe et al. ..... 313/495
4,757,234 7/1988 Ikuta et al. ..... 313/496
4,868,555 9/1989 Watanabe et al. ..... 340/783
4,881,005 11/1989 Morimoto et al. ..... 313/422
4,935,670 6/1990 Watanabe ..... 315/169.1
4,973,888 11/1990 Morimoto et al. ..... 313/422
5,142,388 8/1992 Watanabe et al. ..... 313/496
5,225,820 7/1993 Clerc ..... 345/55

FOREIGN PATENT DOCUMENTS 57-189452 11/1982 Japan ..... 313/497

*Primary Examiner*—Stephen Brinich
*Assistant Examiner*—Jerome Grant, II
*Attorney, Agent, or Firm*—Oblon, Spivak, McClelland, Maier & Neustadt

[57] ABSTRACT

An FEC type fluorescent display device capable of carrying out a segment display of a small capacity. The fluorescent display device includes a substrate; a field emission cathode including a cathode electrode, an emitter and a gate electrode and arranged provided on an inner surface of the substrate for every display unit or digit; a front cover arranged opposite to the substrate for every digit; and a phosphor-deposited anode electrode arranged on an inner surface of the front cover for digit so as to face the field emission cathode. Any one of the cathode electrode, gate electrode and anode electrode is divided into a plurality of segments in a shape of a luminous display section for every digit, resulting in being a segmented electrode. Another one of the cathode electrode, gate electrode and anode electrode acts as a display selecting electrode corresponding to the display unit, resulting in a segment display being carried out.

10 Claims, 7 Drawing Sheets

FLUORESCENT DISPLAY DEVICE

BACKGROUND OF THE INVENTION

This invention relates to a fluorescent display device, and more particularly to a fluorescent display device including a field emission cathode acting as an electron source.

A fluorescent display device is generally classified into two types depending on an electron source thereof. One is a filamentary cathode type fluorescent display device and the other is a field emission cathode (hereinafter referred also to "FEC") type fluorescent display device.

The fluorescent display device is generally constructed in such a manner that filamentary cathodes acting as an electron source, control electrodes and phosphor-deposited anodes functioning as a display section are housed or received in an envelope which is evacuated to a high vacuum.

The FEC type fluorescent display device uses a field emission cathode as its electron source and is generally used for a graphic display, wherein cathodes of the FEC and its gates cooperate to each other to form an X-Y matrix to directly control discharge of electrons from the cathodes and its anodes are formed into a solid shape, resulting in a graphic display desired being carried out.

Unfortunately, the conventional filamentary cathode type fluorescent display device requires a fitment for stretchedly arranging the filamentary cathodes, to thereby cause ends of the device to be cooled. This results in an area of the device which is capable of carrying out a display being significantly reduced, to thereby deteriorate a space factor. Also, the filamentary cathode type fluorescent display device causes a large amount of heat to be generated during the operation and therefore power consumption to be substantially increased. Further, it renders arrangement of spacers in the envelope highly difficult, leading to an increase in thickness and weight of the device.

The conventional FEC type fluorescent display device is directed to a graphic display, therefore, it is so constructed that a relatively high voltage is applied to the anode, to thereby drive the FEC at a reduced duty ratio, resulting in exhibiting luminance required. Unfortunately, such construction causes an increase in driving cost of the device and an excessive increase in voltage, so that the device is not suitable for use for a display of a low capacity other than a graphic display.

SUMMARY OF THE INVENTION

The present invention has been made in view of the foregoing disadvantage of the prior art.

Accordingly, it is an object of the present invention to provide an FEC type fluorescent display device which is capable of being conveniently used for a display of a small capacity.

It is another object of the present invention to provide a fluorescent display device which is capable of carrying out a segment display while selecting plural kinds of luminous colors as desired to carry out a color shift.

It is a further object of the present invention to provide a fluorescent display device which is capable of being extensively decreased in thickness.

It is still another object of the present invention to provide a fluorescent display device which is capable of highly increasing a display area.

It is a still further object of the present invention to provide a fluorescent display device which is capable of significantly reducing power consumption and heat generation.

In accordance with the present invention, a fluorescent display device is provided. The fluorescent display device includes a substrate; a field emission cathode including a cathode electrode, an emitter and a gate electrode and arranged provided on an inner surface of the substrate for every display unit or digit; a front cover arranged opposite to the substrate; and a phosphor-deposited anode electrode arranged on an inner surface of the front cover for every display unit so as to face the field emission cathode. Any one of the cathode electrode, gate electrode and anode electrode is divided into a plurality of segments in a shape of a luminous display section for every display unit, resulting in being a segmented electrode. Another one of the cathode electrode, gate electrode and anode electrode acts as a display selecting electrode corresponding to the display unit, resulting in a segment display being carried out.

In the fluorescent display device of the present invention constructed as described above, the display selecting electrodes are scanned in order from endmost one of the display units or digits and a display signal is fed to the segments of the segmented electrodes desired in synchronism with the scanning. The remaining electrodes are constantly applied thereto a voltage. Electrons discharged from the emitters impinge on the phosphors of the anode electrodes to cause them to emit light, leading to a desired segment display. When the anode electrode is the electrode to which the voltage is constantly applied, a segment display of two or more luminous colors desired may be obtained.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 11(*b*) is a fragmentary perspective view showing a substrate in the fluorescent display device of the seventh embodiment of FIG. 11(*a*);

DETAILED DESCRIPTION OF THE PREFERRED EMBODIMENTS

Now, a fluorescent display device according to the present invention will be described hereinafter with reference to the accompanying drawings.

Figure 1:
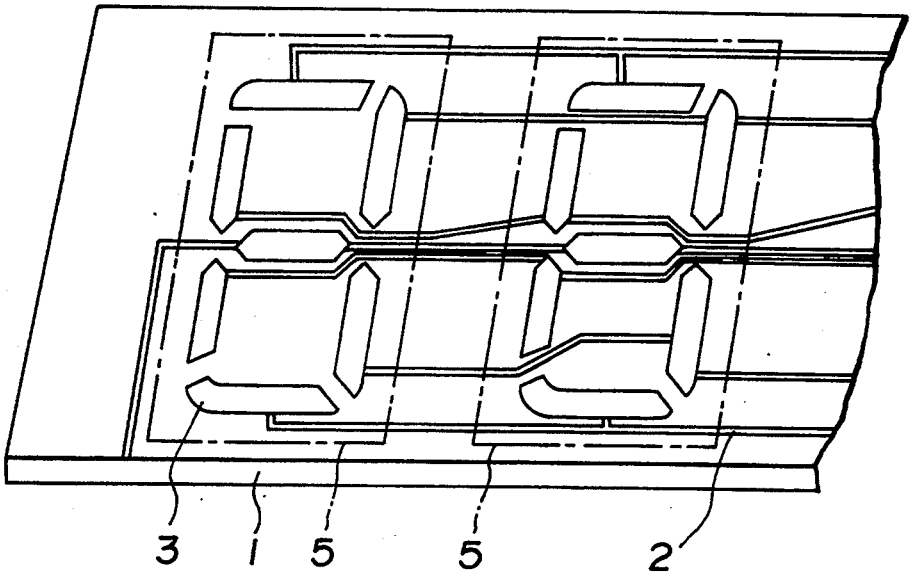
FIG. 1 is a fragmentary perspective view showing a substrate in a first embodiment of a fluorescent display device according to the present invention.
Figure 2:
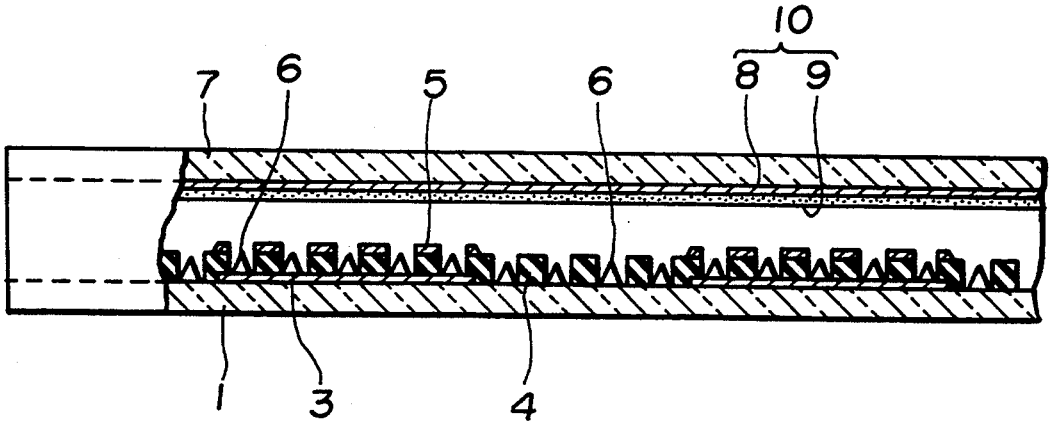
FIG. 2 is a fragmentary sectional view of the fluorescent display device shown in FIG. 1.

Referring first to FIGS. 1 and 2, a first embodiment of a fluorescent display device according to the present invention is illustrated, wherein a cathode electrode is divided into a plurality of segments for every display unit or digit, a gate electrode acts as a display selecting electrode for every digit, and an anode electrode comprises a single anode conductor and a single phosphor and is rendered constantly turned-on or conductive.

More particularly, the fluorescent display device of the first embodiment includes a substrate 1 made of an insulating material, on which wiring conductors 2 and segmented cathode electrodes 3 are arranged. The wiring conductors 2 and cathode electrodes 3 each are made of an thin Al film by photolithography. In the illustrated embodiment, the cathode electrodes 3 each of which is divided into a plurality of segments are arranged so as to form a plurality of digits each consisting of seven such segments disposed in a shape of the FIG. 8. The wiring conductors 2 are arranged in a dynamic wiring pattern which permits the segments of the cathode electrodes of the respective digits corresponding to each other to be connected together therethrough.

Also, the substrate 1 is formed thereon with an insulating layer 4 by sputtering or vapor deposition. The insulating layer 4 is made of $SiO_2$ all over the substrate 1. Then, the insulating layer 4 is provided thereon with a gate electrode 5 for every digit, which is formed by depositing a thin Mo film on the insulating layer 4. The gate electrode 5 is independently arranged for every digit which is a display unit comprising the above-described seven segments of the cathode electrode 3.

The gate electrodes 5 and insulating layer 4 are formed with common holes by etching. Then, an emitter material is deposited in each of the holes to form an emitter 6 of a conical shape therein. Of the emitters 6 thus formed, only the emitters 6 which are formed on the cathode electrodes 3 constitute an electron discharge section effective to discharge electrons and the remaining emitters 6 do not function to discharge electrons.

The fluorescent display device of the illustrated embodiment also includes a front cover 7 provided opposite to the substrate 1. The front cover 7 is formed on a whole inner surface thereof with a single anode electrode 10. The anode electrode 10 comprises a single anode conductor 8 made of a transparent conductive film and a single phosphor 9 deposited all over the anode conductor 8. The phosphor 9 is selected depending on a luminous color desired.

Between the substrate 1 and the front cover 7 opposite to each other are arranged spacer members (not shown) in a manner to be positioned at an outer periphery of the substrate and front cover, resulting in an envelope being provided, which is then evacuated to a high vacuum.

In the fluorescent display device of the illustrated embodiment constructed as described above, the gate electrodes 5 are scanned or fed with a scanning signal in order from endmost one of the digits, and a display signal is applied, in synchronism with the scanning signal, to the cathode electrodes 3 desired to emit light. The anode electrode is kept constantly turned on, so that of the segments of the cathode electrodes 3 of the digits selected, only the segments to which the display signal is applied permit the corresponding emitters 6 to discharge electrons. The electrons thus discharged from the selected emitters impinge on only an area of the opposite phosphor 9 which is of the same configuration as the segments of the cathode electrodes selected, so that the phosphor 9 of the anode electrode 10 emits light in the same shape as the selected segments.

Figure 3:
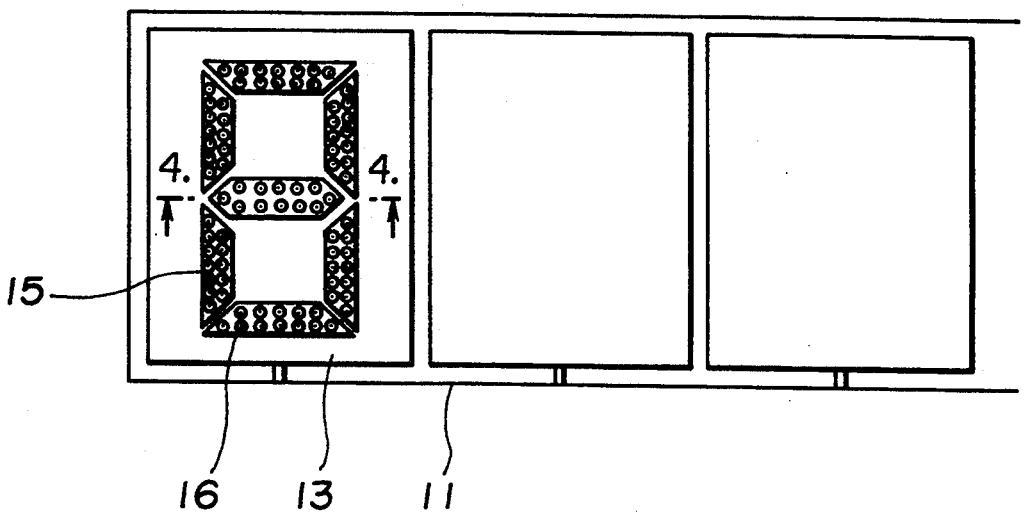
FIG. 3 is a fragmentary plan view showing a substrate in a second embodiment of a fluorescent display device according to the present invention.
Figure 4:
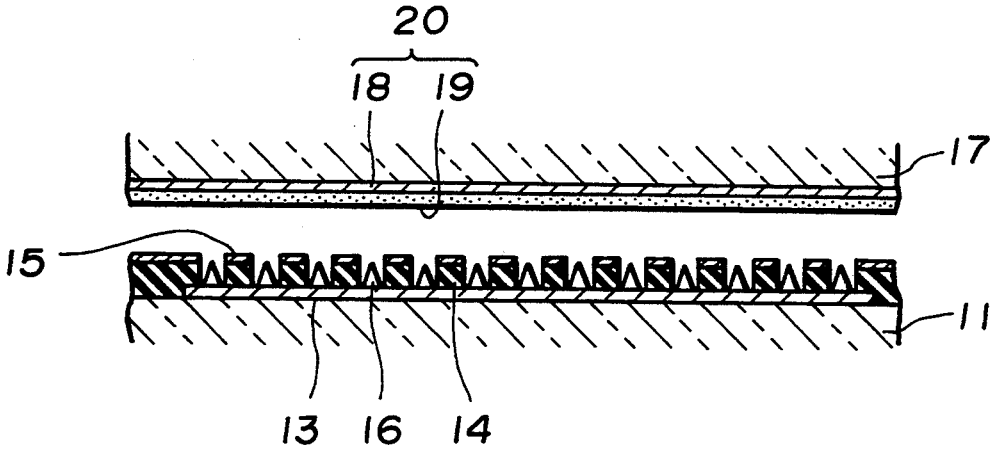
FIG. 4 is a sectional view taken along line X—X of FIG. 3.

Referring now to FIGS. 3 and 4, a second embodiment of a fluorescent display device according to the present invention is illustrated. In a fluorescent display device of the second embodiment, a cathode electrode 13 acts as a display selecting electrode for every digit, a gate electrode 15 is divided into a plurality of segments, resulting in being a segmented electrode for every digit, and an anode electrode 20 comprises a single anode conductor and a single phosphor and is rendered constantly turned-on or conductive.

More particularly, the cathode electrodes 13 for a plurality of digits each forming a display unit are arranged on an insulating substrate 11 in a manner to be electrically independent from each other. The cathode electrodes 13 each are made of a thin Al film by photolithography. Then, the cathode electrodes 13 each are formed thereon with an insulating layer 14. The insulating layer 14 is made of $SiO_2$ by sputtering. Subsequently, a gate electrode 15 is formed on the insulating layer 14 by depositing a thin Mo film on the insulating layer 14.

Figure 8:
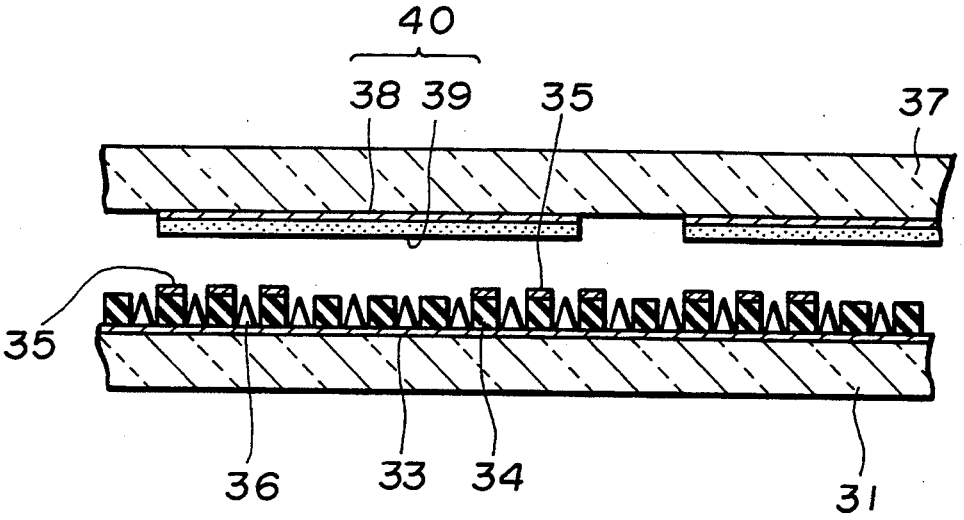
FIG. 8 is a fragmentary sectional view of the fluorescent display device shown in FIG. 7.

Then, the gate electrode 15 is divided into a plurality of segments in a shape of the FIG. 8, each of which is then formed with a hole. Multiplex connection (dynamic connection) is carried out with respect to the gate electrode 15 thus divided into the segments. More particularly, the segments of the segmented gate electrodes 15 of the respective digits which correspond to each other are connected commonly. Subsequently, the insulating layers 14 are formed with holes by etching. Then, an emitter material is deposited in each of the holes to form an emitter 16 of a cone-like shape.

The fluorescent display device also includes a front cover 17 arranged opposite to the substrate 11, which front cover cooperates with the substrate 11 to form an envelope. The front cover 17 is formed on an inner surface thereof with a single anode conductor 18 in a manner to cover the whole inner surface of the front cover 17. The anode conductor is made of an ITO (indium tin oxide) film. Then, a phosphor 19 is deposited on the anode conductor 18, resulting in an anode electrode 20 being formed.

In the fluorescent display device of the second embodiment constructed as described above, the cathode electrode 13 is scanned for every digit or display unit. In synchronism with the scanning, a display signal is fed to the segments of the gate electrode 15 desired. This causes an electric field to be produced between the segments of the gate electrode 15 thus selected and the emitters 16, resulting in electrons being discharged from the emitters 16. Then, the electrons impinge on an area of the phosphor 19 opposite thereto, so that the phosphor emits light in a pattern of the segments selected.

A portion of the insulating layer 14 free of the segmented gate electrode 15 is likewise formed with holes, in which the emitters 16 are formed. However, the emitters of the portion fail to contribute to discharge of electrons because the portion is free of any gate electrode.

Figure 5:
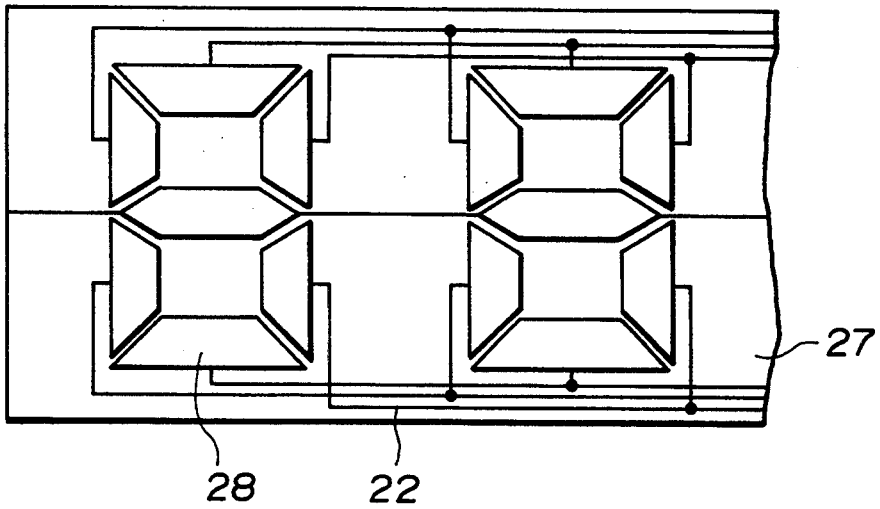
FIG. 5 is a fragmentary bottom view showing a front cover in a third embodiment of a fluorescent display device according to the present invention.
Figure 6:
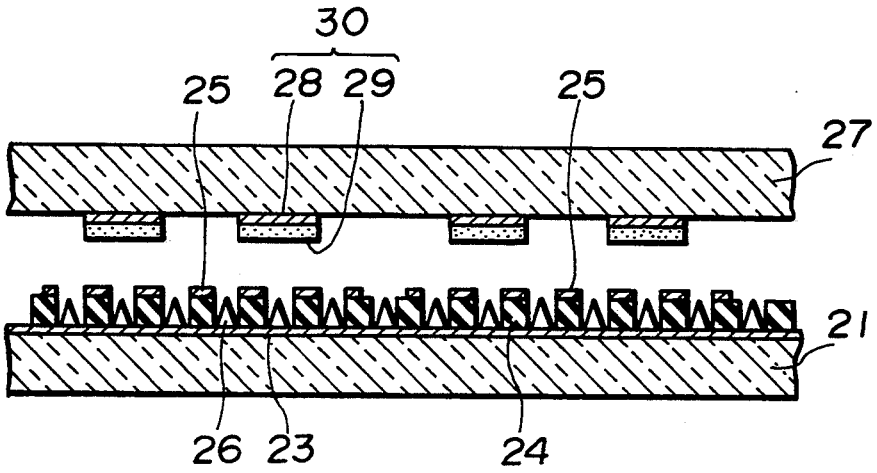
FIG. 6 is a fragmentary sectional view of the fluorescent display device shown in FIG. 5.
Figure 10:
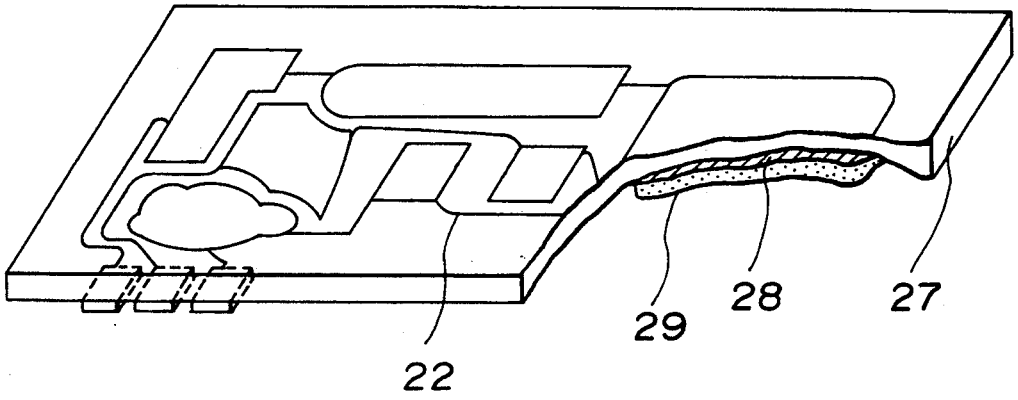
FIG. 10 is a partly cutaway perspective view showing a modification of a front cover in the third embodiment shown in FIGS. 5 and 6.

FIGS. 5 and 6 show a third embodiment of a fluorescent display device according to the present invention. A fluorescent display device of the illustrated embodiment is generally constructed in such a manner that a cathode electrode 23 is a single electrode formed into a solid shape, a gate electrode 25 acts as a display selecting electrode for every digit, and an anode electrode 30 is divided into a plurality of segments for every digit. In the illustrated embodiment, the anode electrode 30 is divided into seven segments in a shape of the FIG. 8 for every digit. However, arrangement of the segments is not limited to such a 8-shaped pattern. For example, the segments may be arranged in any other suitable configuration such as a pattern shown in FIG. 10.

The fluorescent display device of the third embodiment likewise includes an insulating substrate 21. The above-described cathode electrode 23 is made of a thin Al film and formed in a solid manner or all over the substrate 21. Then, an insulating layer 24 which is made of $SiO_2$ is provided on a whole surface of the cathode electrode 23. Further, the gate electrodes 25 for the respective digits are formed on the insulating layer 24 in a manner to be independent from each other. The gate electrodes 25 and insulating layer 24 are formed with common holes, in which emitters 26 of a cone-line shape are formed.

Reference numeral 27 designates a front cover 27 arranged opposite to the substrate 21, which is provided on an inner surface thereof with wiring conductors 22 made of a thin Al film and anode electrodes 30. The anode electrodes 30 each comprise an anode conductor 28 made of a transparent conductive film (ITO) and a phosphor layer 29. The anode conductor 28 is divided into a plurality of segments for every digit and the segments of the anode conductors corresponding to each other are connected through wiring conductors 22 in a dynamic connection manner.

In the fluorescent display device of the third embodiment constructed as described above, the gate electrodes 25 are selectively scanned while keeping a voltage constantly applied to the cathode electrode 23. Also, in synchronism with the scanning, the segments of the anode conductors 28 desired are fed with a display signal. This results in electrons being discharged from the cathode electrode 23 at every digit, so that the segments of the anode conductors 28 selected may emit light.

Figure 7:
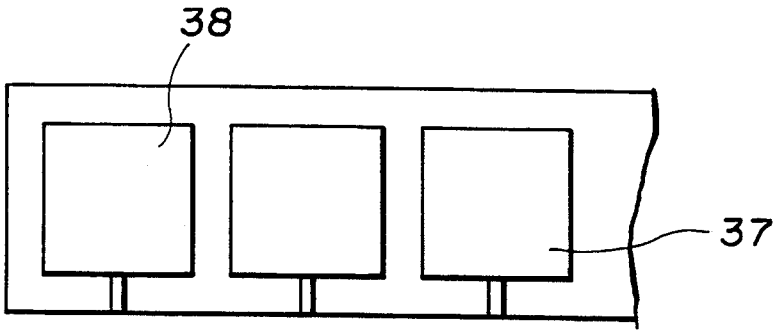
FIG. 7 is a fragmentary bottom view showing a front cover in a fourth embodiment of a fluorescent display device according to the present invention.

Referring now to FIGS. 7 and 8, a fourth embodiment of a fluorescent display device according to the present invention is illustrated. In the fourth embodiment, a cathode electrode 33 is formed into a single solid shape so as to be common to all digits, a gate electrode 35 is divided into a plurality of segments for every digit and an anode electrode 40 acts as a display selecting electrode for every digit. The cathode electrode is constructed in the same manner as that in the third embodiment and the gate electrode 35 is constructed in the same manner as that in the second embodiment.

The anode electrodes 40 for the respective digits are arranged in a manner to be separate from each other on a front cover 37. The anode electrodes 40 each comprise an anode conductor 38 formed on an inner surface of the front cover 37 and a phosphor layer 39 deposited on the anode conductor 38.

In the fourth embodiment constructed as described above, the anode electrodes 40 are scanned and, in synchronism with the scanning, the segmented gate electrodes 35 are fed with a display signal. The cathode electrode. 33 is constantly applied thereto a voltage. This results in a voltage being applied between the segments of the gate electrodes 35 selected by the display signal and the emitters 36, leading to discharge of electrons from the emitters. The segments of the gate electrodes 35 of the respective digits which correspond to each other are connected together by a dynamic connection manner, so that all the corresponding segments are caused to emit light. However, light emission is carried out by only the digits or display units corresponding to the anode electrodes 38 to which the anode voltage is applied.

Figure 9:
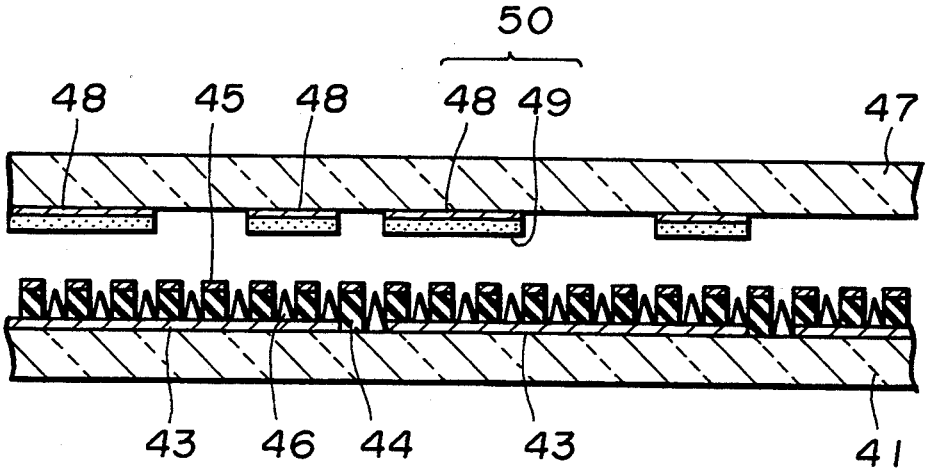
FIG. 9 is a fragmentary sectional view showing a fifth embodiment of a fluorescent display device according to the present invention.

Now, a fifth embodiment of a fluorescent display device according to the present invention will be described with reference to FIG. 9. In the fifth embodiment, a cathode electrode 43 acts as a display selecting electrode as in the second embodiment described above. A gate electrode 45 is a non-controllable electrode and constructed in the form of a single continuous electrode. An anode electrode 50 is divided into a plurality of segments as in the third embodiment.

In the fifth embodiment constructed as described above, the cathode electrode 43 is scanned or fed with a scanning signal for every digit and a gate voltage is constantly applied to the gate electrode 45. Also, a display signal is fed to the anode electrode 50 in synchronism with the scanning. This results in electrons being discharged from emitters 46 of the cathode electrodes 43 to which the scanning signal is fed. The electrons then impinge on only the segments of the anode electrodes 50 selected, so that a desired luminous display may be accomplished.

Now, a sixth embodiment of a fluorescent display device according to the present invention will be described hereinafter. In the sixth embodiment, a cathode electrode 3 is divided into a plurality of segments for every digit like the cathode electrode 3 in the first embodiment described above and a gate electrode 45 is formed into a single solid shape so as to be common to the digits like the gate electrode 45 in the fifth embodiment described above. Also, an anode electrode 40 acts as a display selecting electrode for every digit like the anode electrode 40 in the fourth embodiment described above. Therefore, in the sixth embodiment, the cathode electrode, gate electrode and anode electrode will be described while being indicated at reference numeral 3, 45 and 40, respectively.

In the sixth embodiment thus constructed, a scanning signal is fed to the anode electrodes 40 while keeping a gate voltage constantly applied to the gate electrode 45. Also, in synchronism with the scanning, a display signal is fed to the cathode electrodes 3. Thus, in each of digits selected, emitters of the segments of the cathode electrode 3 to which the display signal is fed are caused to discharge electrons, which then impinge on the phosphor of the anode electrode 40 selected, so that a luminous display is carried out in a pattern of the segments of the cathode electrode 3.

Figure 11A:
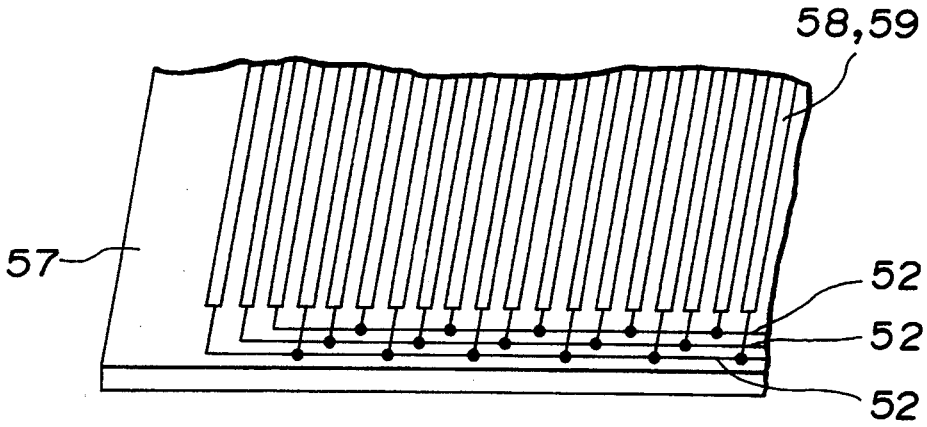
FIG. 11(*a*) is a fragmentary perspective view showing a front cover in a seventh embodiment of a fluorescent display device according to the present invention.
Figure 11B:
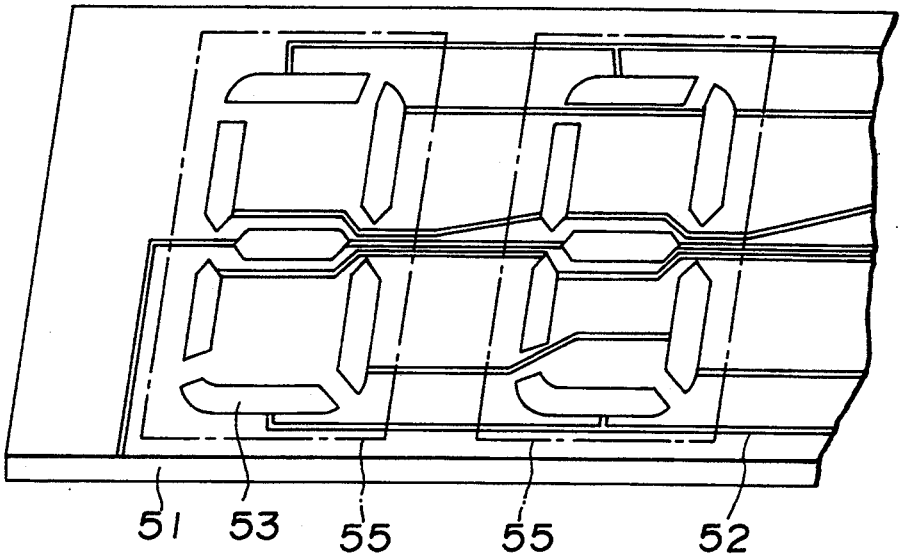
Figure 12:
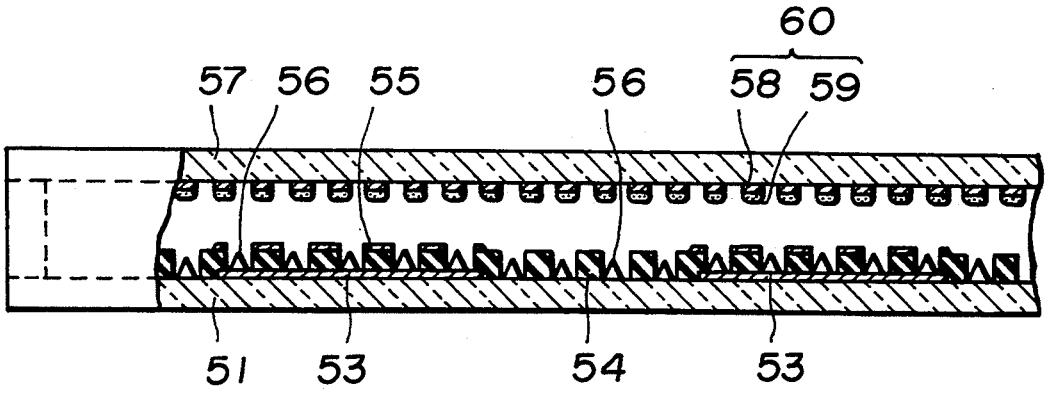
FIG. 12 is a fragmentary sectional view of the fluorescent display device of the seventh embodiment of FIG. 11(*a*)

Now, a seventh embodiment of a fluorescent display device according to the present invention and a method for manufacturing the device will be described hereinafter with reference to FIGS. 11 and 12. In the seventh embodiment, a cathode electrode 53 is divided into a plurality of segments for every digit, a gate electrode 55 serves as a display selecting electrode for every digit and anode electrodes 60 each are formed into a stripe-like shape. These electrodes are received in a box-like envelope formed by a substrate 51 and a front, cover 57 arranged opposite to each other so as to be spaced at a predetermined interval.

In the seventh embodiment, the substrate 51 is made of an insulating material, on which wiring conductors 52 and a plurality of segmented cathode electrodes 53 which are formed of a thin Al film by photolithography are arranged. The cathode electrodes 53 are arranged to form a plurality of digits and, for this purpose, each of the cathode electrodes 53 is divided into seven segments arranged in a shape of the FIG. 8 for every digit. Also, the wiring conductors 52 are arranged in a dynamic wiring pattern so that the segments of the cathode electrodes of the respective digits which correspond to each other may be connected together.

Also, the insulating substrate 51 is provided thereon with an insulating layer 54, which is formed of $SiO_2$ into a solid shape by sputtering or vapor deposition. Then, on the insulating layer 54 is deposited a thin Mo film to form the gate electrodes 55. The gate electrodes 55 for the respective display units or digits each formed by the segmented cathode electrode 53 are arranged independent from each other. The gate electrode 55 and insulating layer 54 are formed with common holes by etching. Then, an emitter material is deposited in each of the holes to form an emitter 56 of a conical shape therein. Only the emitters formed on the cathode electrodes 53 constitute an electron discharge section effective to discharge electrons therefrom, thus, the remaining emitters do not contribute to discharge of electrons.

The front cover 57 arranged opposite to the substrate 51 is formed on an inner surface thereof with the anode electrodes 60 of a stripe-like shape briefly described above. The anode electrodes 60 include stripe-like anode conductors 58, respectively, which are arranged so as to be spaced from each other at predetermined intervals on the inner surface of the front cover 57. The anode conductors 58 are depositedly provided thereon with phosphor layers 59 different in luminous color or of red, green and blue luminous colors in a predetermined order and in a repeated manner, respectively. Of the stripe-like anode conductors 60 thus constructed, the anode conductors having the phosphor layers 59 of the same luminous colors deposited thereon are connected together through the wiring conductors 52 common thereto and led out of the envelope, respectively.

Thus, the fluorescent display device of the seventh embodiment constructed as described above permits the anode electrodes 60 to be selected so that only one of the three luminous luminous colors or a combination of two or three luminous colors may be obtained as desired. Also, the illustrated embodiment may permit any display of seven luminous colors to be selected as desired. Emission of the anode electrode 60 is carried out in the form of a stripe-like-shape, so that a sufficient decrease in pitch or interval between the anode electrodes substantially prevents the stripe-like shape from adversely affecting the quality of a luminous display.

In the seventh embodiment constructed as described above, the gate electrodes 55 are scanned or fed with a scanning signal in order from endmost one of the digits and, in synchronism with the scanning signal, a display signal is fed to the segments of the cathode electrodes 53 of which emission is desired. Of the segments of the cathode electrodes 53 of the digits selected, only the segments to which the display signal is fed permit the emitters 56 to discharge electrons. Of the anode electrodes 60 opposite to the emitters, only the anode electrodes 60 of desired luminous colors are selected, so that a voltage may be applied to the anode conductors 58 of the selected anode electrodes 60. The electrons thus discharged are causes to impinge on a predetermined region of the phosphor layers 59 of the stripe-like anode electrodes 53 which are of the selected luminous colors and opposite to the segments of the phosphors 59 selected, resulting in the phosphor layers emitting light. Thus, the predetermined region has the same configuration as a pattern of the selected segments.

Figure 13:
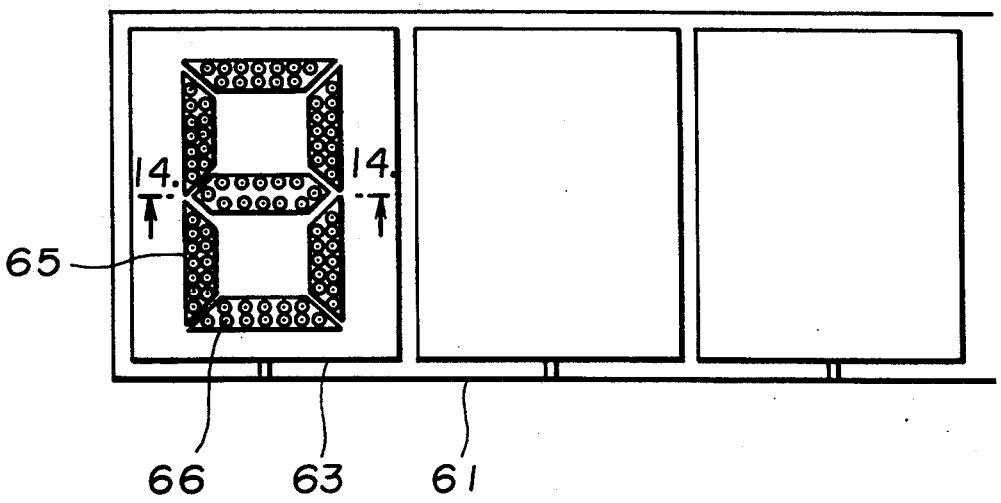
FIG. 13 is a fragmentary plan view showing a substrate in an eighth embodiment of a fluorescent display device according to the present invention.
Figure 14:
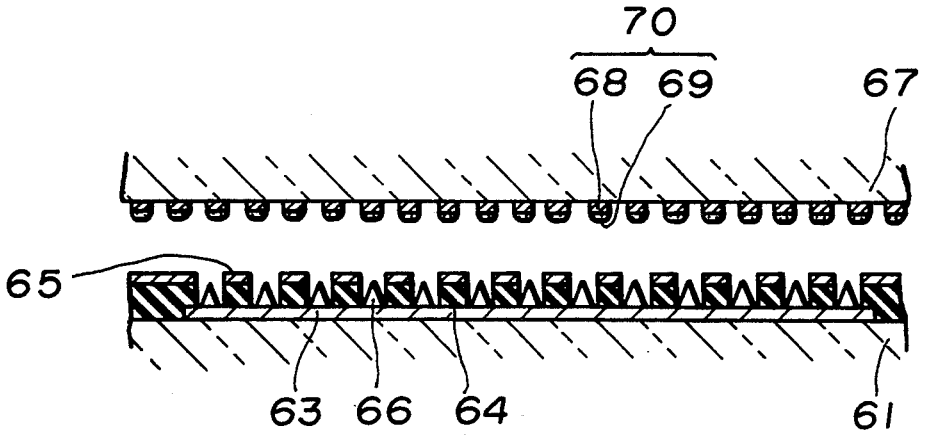
FIG. 14 is a sectional view taken along line X—X of FIG. 13.

Referring now to FIGS. 13 and 14, an eighth embodiment of a fluorescent display device according to the present invention is illustrated, wherein a cathode electrode 63 serves as a display selecting electrode for every digit, a gate electrode 65 is divided into a plurality of segments for every digit, resulting in being a segmented electrode, and an anode electrode 70 is constructed in substantially the same manner as that in the first embodiment described above.

More particularly, the cathode electrodes 63 for respective display units or digits are formed on an insulating substrate 61 in a manner to be electrically independent from each other. The cathode electrodes 63 each are made of an thin Al film by photolithography. Then, an insulating layer 64 is formed of $SiO_2$ on the cathode electrodes 63 by sputtering and then a thin Mo film is deposited on the insulating layer 64 to form the gate electrode 65 for every digit.

Then, the gate electrodes 65 each are divided into a plurality of segments by photolithography. Subsequently, the segments each are formed with a hole. The gate electrodes are connected together by dynamic connection. More particularly, the segments of the gate electrodes 65 for the respective digits which correspond to each other are connected to each other. Subsequently, the insulating layer 64 is formed with holes, in each of which an emitter material is then deposited to form emitter 66.

Opposite to the substrate 61 is arranged a front cover 67, which cooperates with the substrate 61 to form an envelope. The front cover 67 is formed on an inner surface thereof with stripe-like anode conductors 68, which are made of an ITO film. The anode conductors 68 are then depositedly formed thereon with phosphor layers 69 different in luminous color in a predetermined order and in a repeated manner, resulting in the stripe-like anode conductors 70 being prepared.

In the fluorescent display device of the eighth embodiment constructed as described above, the cathode electrode 63 is scanned for every digit. In synchronism with the scanning, the segments of the gate electrode 65 desired are fed with a display signal. This causes an electric field to occur between the segments of the gate electrode 65 selected and the emitters, so that electrons may be discharged from the emitters. A voltage is applied to only the anode electrodes of luminous colors desired, to thereby cause the electrons discharged from the emitters to impinge on only the phosphor layers of the anode conductors selected, resulting in the phosphor layers of desired luminous colors emitting light in the same pattern as the segments selected.

The cathode electrode is formed at a portion thereof except a portion thereof corresponding to the segmented gate electrodes 65 with the holes and therefore the emitters. However, the portion of the cathode electrode is free of the gate electrode, so that the emitters of the portion do not contribute to discharge of electrons.

In each of the embodiments described above, the segments for every digit are arranged in a pattern of the FIG. 8. However, they may be arranged in any other suitable pattern or configuration such as a dot-like pattern or the like.

As can be seen from the foregoing, the fluorescent display device exhibits a lot of advantages.

More particularly, any of the cathode electrode, gate electrode and anode electrode may be constructed in a segmented pattern for every digit, so chat the present invention permits a degree of freedom of the design to be significantly increased.

Also, the fluorescent display device of the present invention is free of any grid and substitutes field emission cathodes (FECs) for filamentary cathodes, to thereby permit a gap or distance between the cathode electrode and the anode electrode to be decreased to a level as small as several hundred microns. Thus, the fluorescent display device of the present invention can be extensively reduced in thickness.

Further, the present invention permits the FECs to be arranged in all parts of a package, so that a substantially whole area of the package may be used as a display region.

In the present invention, pattern formation may be carried out by subjecting a thin film to photo-etching. This permits luminance to be highly increased and a gap between patterns to be significantly reduced.

Furthermore, an FEC is a cold cathode, so that the fluorescent display device of the present invention in which the FECs are incorporated reduces power consumption and substantially eliminates heat generation.

Moreover, the fluorescent display device of the present invention accomplishes a segment display of a single luminous color or any combination of plural luminous colors while preventing complication of the structure.

While preferred embodiment of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device comprising at least one display unit said device comprising:

a substrate;

a field emission cathode including at least one cathode electrode, at least one emitter and at least one gate electrode arranged on an inner surface of each of said display unit;

a front cover arranged opposite to said substrate;

a phosphor-deposited anode electrode made up of anode conductors and arranged on the inner surface of said front cover of each display unit and positioned so as to face said field emission cathode and which is divided into a plurality of segments in the shape of a luminous display section for every display unit, thereby providing a resulting segmented electrode;

wherein each of said gate electrode is a display selecting electrode corresponding to each of display units, resulting in a segment display being provided;

multiplexing means coupled to said gate electrodes; and scanning means to scan said multiplexed gate electrodes and said anode conductors with a synchronized signal.

2. A fluorescent display device as defined in claim 1, wherein said anode conductors of said anode electrode each are formed into a stripe-like shape.

3. A fluorescent display device as defined in claim 1, wherein said phosphors of said anode conductors are repeatedly arranged in order of red, green and blue luminous colors.

4. A fluorescent display device as in claim 1 wherein the phosphor deposited on said anode electrode is comprised of different luminous colors.

5. A fluorescent display device comprising at least one display unit said device comprising:

a substrate;

a field emission cathode including at least one cathode electrode, at least one emitter and at least one gate electrode arranged on an inner surface of each of said display unit;

a front cover arranged opposite to said substrate;

a phosphor-deposited anode electrode made up of anode conductors and arranged on the inner surface of said front cover of each display unit and positioned so as to face said field emission cathode and which is divided into a plurality of segments in the shape of a luminous display section for every display unit, thereby providing a resulting segmented electrode;

wherein each of said cathode electrode is a display selecting electrode corresponding to each of display units, resulting in a segment display being provided;

means to provide a constant signal to said gate electrode;

multiplexing means coupled to said cathode electrodes; and scanning means to scan said multiplexed cathode electrodes and said anode conductors with a synchronized signal.

6. A fluorescent display device comprising at least one display unit said device comprising:

a substrate;

a field emission cathode including at least one cathode electrode, at least one emitter and at least one gate electrode arranged on an inner surface of each of said display unit;

a front cover arranged opposite to said substrate;

a phosphor-deposited anode electrode made up of anode conductors and arranged on the inner surface of said front cover of each display unit and positioned so as to face said field emission cathode;

wherein said gate electrode is divided into a plurality of segments in the shape of a luminous display section for every display unit, thereby providing a resulting segmented electrode;

wherein each of said gate electrode is a display selecting electrode corresponding to each of display units, resulting in a segment display being provided;

multiplexing means coupled to said anode electrodes; and scanning means to scan said multiplexed anode electrodes and said cathode electrode segments with a synchronized signal.

7. A fluorescent display device comprising at least one display unit said device comprising:

a substrate;

a field emission cathode including at least one cathode electrode, at least one emitter and at least one gate electrode arranged on an inner surface of each of said display unit;

a front cover arranged opposite to said substrate;

a phosphor-deposited anode electrode made up of anode conductors and arranged on the inner surface of said front cover of each display unit and positioned so as to face said field emission cathode;

wherein said cathode electrode is divided into a plurality of segments in the shape of a luminous display section for every display unit, thereby providing a resulting segmented electrode; wherein each of said anode electrode is a display selecting electrode corresponding to each of display units, resulting in a segment display being provided;

multiplexing means coupled to said anode electrodes; and scanning means to scan said multiplexed anode electrodes and said cathode electrode segments with a synchronized signal.

8. A fluorescent display device comprising at least one display unit said device comprising:

a substrate;

a field emission cathode including at least one cathode electrode, at least one emitter and at least one gate electrode arranged on an inner surface of each of said display unit;

a front cover arranged opposite to said substrate;

a phosphor-deposited anode electrode made up of anode conductors and arranged on the inner surface of said front cover of each display unit and positioned so as to face said field emission cathode;

wherein said gate electrode is divided into a plurality of segments in the shape of a luminous display section for every display unit, thereby providing a resulting segmented electrode;

wherein each of said cathode electrode is a display selecting electrode corresponding to each of display units, resulting in a segment display being provided;

multiplexing means coupled to said cathode electrodes; and scanning means to scan said multiplexed cathode electrodes and said gate electrode segments with a synchronized signal.

9. A fluorescent display device comprising at least one display unit said device comprising:

a substrate;

a field emission cathode including at least one cathode electrode, at least one emitter and at least one gate electrode arranged on an inner surface of each of said display unit;

a front cover arranged opposite to said substrate;

an anode electrode covered by a phosphor layer and made up of a anode conductor and arranged on the inner surface of said front cover of each display unit and positioned so as to face said field emission cathode;

wherein said cathode electrode is divided into a plurality of segments in the shape of a luminous display section for every display unit, thereby providing a resulting segmented electrode;

wherein each of said gate electrode is a display selecting electrode corresponding to each of display units, resulting in a segment display being provided;

multiplexing means coupled to said cathode electrodes; and scanning means to scan said multiplexed cathode electrodes and said gate electrode segments with a synchronized signal.

10. A fluorescent display device comprising at least one display unit said device comprising:

a substrate;

a field emission cathode including at least one cathode electrode, at least one emitter and at least one gate electrode arranged on an inner surface of each of said display unit;

a front cover arranged opposite to said substrate;

a phosphor-deposited anode electrode made up of anode conductors and arranged on the inner surface of said front cover of each display unit and positioned so as to face said field emission cathode;

wherein said cathode electrode is divided into a plurality of segments in the shape of a luminous display section for every display unit, thereby providing a resulting segmented electrode;

wherein each of said gate electrode is a display selecting electrode corresponding to each of display units, resulting in a segment display being provided;

multiplexing means coupled to said anode electrodes; and scanning means to scan said multiplexed anode electrodes and said cathode electrode segments with a synchronized signal.

* * * * *